US006062497A

United States Patent [19]

Bryan

[11] Patent Number: 6,062,497

[45] Date of Patent: May 16, 2000

[54] FUEL INJECTOR NOZZLE ASSEMBLY WITH IMPROVED NEEDLE CHECK VALVE STOP MECHANISM

[75] Inventor: James G. Bryan, Dunlap, Ill.

[73] Assignee: Caterpillar Inc., Peoria, Ill.

[21] Appl. No.: 08/591,251

[22] Filed: Jan. 19, 1996

[51] Int. Cl.[7] ..... F02M 61/10

[52] U.S. Cl. ..... 239/533.11; 239/533.9

[58] Field of Search ..... 239/88, 96, 533.2, 239/533.8, 533.9, 533.11, 585.1

[56] References Cited

U.S. PATENT DOCUMENTS

| | | | |
|---|---|---|---|
| 2,358,494 | 9/1944 | Haines | 299/107.6 |
| 3,042,317 | 7/1962 | Simmons | 239/453 |
| 3,469,793 | 9/1969 | Guertler | 239/533 |
| 3,675,853 | 7/1972 | Lapers | 239/464 |
| 4,096,995 | 6/1978 | Klomp | 239/94 |
| 4,168,804 | 9/1979 | Hofmann | 239/533.11 |
| 4,650,121 | 3/1987 | Augustin | 239/533.11 X |
| 4,715,542 | 12/1987 | Morell et al. | 239/533.9 |
| 4,804,143 | 2/1989 | Thomas | 239/126 |
| 4,840,310 | 6/1989 | Haider | 239/533.4 |
| 5,012,786 | 5/1991 | Voss | 239/533.9 X |
| 5,110,053 | 5/1992 | Stevens | 239/533.11 X |
| 5,452,858 | 9/1995 | Tsuzuki et al. | 239/533.8 |
| 5,727,738 | 3/1998 | Hofmann et al. | 239/533.9 X |

FOREIGN PATENT DOCUMENTS

| | | |
|---|---|---|
| 1594174 | 3/1978 | United Kingdom . |
| 2226078 | 6/1990 | United Kingdom . |
| 92/19857 | 11/1992 | WIPO . |

*Primary Examiner*—Andres Kashnikow
*Assistant Examiner*—Steven J. Ganey
*Attorney, Agent, or Firm*—Michael McNeil

[57] ABSTRACT

In some fuel injectors having VOP (valve opening pressure) type needle checks, the check return spring cavity also functions as a portion of the fuel supply passage. A return spring is compressed within the return spring cavity between an end wall and one end of the needle check. Instead of utilizing a pin stop to limit the movement of the needle check as in the prior art, the present invention utilizes a shoulder stop surface which comes into contact with one end of the needle check when the needle valve is fully open. This elimination of the prior art pin stop is believed to eliminate or reduce cavitation damage to the check return spring, pin chipping problems, beat in problems due to pin stop cocking or tipping within the return spring cavity, and other wear and functionality problems caused by a free floating pin stop.

9 Claims, 3 Drawing Sheets

FUEL INJECTOR NOZZLE ASSEMBLY WITH IMPROVED NEEDLE CHECK VALVE STOP MECHANISM

TECHNICAL FIELD

The present invention relates generally to nozzle assemblies for fuel injectors, and in particular to an improved needle check valve stop mechanism for valve opening pressure (VOP) type fuel injectors.

BACKGROUND ART

Prior art fuel injectors of the type to which the present invention finds application include an injector body having a fuel pressurization chamber that opens to a fuel supply passage and a nozzle supply passage. The injector body also has a nozzle chamber that opens to a nozzle outlet and the nozzle supply passage. A portion of the fuel supply passage is a return spring cavity. A needle check is positioned to reciprocate in the nozzle chamber between a closed position that closes the nozzle outlet and an open position that opens the nozzle outlet. One end of the needle check is exposed within the return spring cavity, and a return spring is compressed in the return spring cavity between the one end of the needle check and an end wall of the cavity. The return spring serves as a means by which the needle check is biased toward its closed position. The needle check includes at least one hydraulic lift surface exposed to the nozzle chamber such that the needle check will move to an open position against the action of the return spring when sufficient hydraulic pressure acts on the hydraulic lift surfaces. A stop pin is positioned within the return spring cavity, and serves as the means by which the movement of the needle check is limited. In other words, the pin acts as a stop and limits the distance that the needle check can move against the action of the return spring. These various components are normally centered about an axis such that the return spring surrounds the pin, which is aligned with the central axis of the injector.

In such prior art fuel injectors, the stop pin is a separate piece and is free to move within the return spring cavity, constrained only by the inner diameter of the return spring and the end walls of the cavity. In other words, the stop pin must necessarily have a smaller diameter than the inner diameter of the return spring in order to minimize interference between the two, and there must be some up and down movement available in order to allow the needle check to open during an injection event. Over time, this freedom of pin movement can cause several problems that often result in a shortened working life for an individual injector. One of these problems occurs when the pin becomes cocked or tilted in its orientation such that the stress is concentrated at the corner edges of the pin when the needle check opens. As the injector goes through numerous injection cycles, this tilted or cocked orientation of the pin stop can result in chipping and/or deformation of the normally plainer stop surfaces that contact one another when the needle check opens. Also loose metal fragments caused by pin chipping can become lodged at locations within the injector that cause a significant disruption or more serious malfunction in the injector. Finally, the deformation and excessive wear caused to the pin and its associated contact surfaces can also undermine and/or disrupt the performance of the injector.

Over time, excessive wear on the return spring can also occur because of one or more reasons, such as spacer tilting. This wear on the return spring can eventually weaken the spring and change the valve opening pressure of the needle check. The valve opening pressure can also be altered by tilting of the return spring itself. Those skilled in the art will appreciate that a change in the valve opening pressure can have a significant affect on injector performance, particularly injection mass flow rate and amount. Eventually, the unnecessary wearing on the return spring can cause spring breakage which results in a catastrophic malfunction in the injector.

Still another problem identified in prior art fuel injectors of this type is cavitation damage to the return spring. This phenomenon is believed to occur when the needle check is moving from its open position to its closed position under the action of the return spring. When this happens, the volume of the return spring cavity necessarily increases with the movement of the needle check. Because the pin stop and the return spring take up a substantial portion of the available volume in the return spring cavity, only a limited volume is available for fluid transfer. This limited fluid volume availability becomes acute when the needle check moves toward its closed position. In other words, negative pressure is created within the return spring cavity during the. abrupt volume increase that occurs when the needle check moves toward its closed position. This abrupt drop in pressure briefly causes cavitation to occur primarily in the neighborhood of the end coils of the return spring. Over time, this cavitation causes excessive wear on the return spring causing the same to be weakened or otherwise damaged. This weakening of the return spring due to cavitation can also undesirably alter the valve opening pressure of the needle check.

The present invention is directed to overcoming these and other problems associated with the nozzle assemblies for fuel injectors.

DISCLOSURE OF THE INVENTION

A nozzle assembly for a fuel injector according to the present invention includes a cylindrical body portion defining a hollow interior. A plurality of blocks are positioned in the hollow interior and stacked on top of one another. Together, the cylindrical body and the plurality of blocks define a fuel supply passage, a nozzle supply passage and a nozzle outlet. They further define a nozzle chamber that opens to the nozzle outlet and the nozzle supply passage. A portion of the fuel supply passage is a return spring cavity. A needle check is positioned in the nozzle chamber and is capable of reciprocating between a closed position that closes the nozzle outlet and an open position that opens the nozzle outlet. The needle check includes at least one hydraulic lift surface exposed to the nozzle chamber. The return spring cavity is defined at least in part by one end of the needle check, an end wall and a shoulder stop surface. A return spring is compressed in the return spring cavity between the one end of the needle check and the end wall. The one end of the needle check comes into contact with the shoulder stop surface of the return spring cavity when the needle check has moved to its open position, but is separated from the shoulder stop surface when the needle check is in its closed position. The present invention eliminates the need for the pin stop of the prior art.

One object of the present invention is to reduce the number of moveable parts in a nozzle assembly for a fuel injector.

Another object of the present invention is to reduce or eliminate cavitation damage to needle check return springs.

Still another object of the present invention is to reduce at least one part interface in fuel injector nozzle assemblies.

Another object of the present invention is to eliminate one potential source of metal fragments that could damage fuel injector nozzle assemblies.

Another object of the present invention is to increase the volume of the return spring cavity/fuel supply passage of a fuel injector nozzle assembly.

Still another object of the present invention is to extend the working life of fuel injectors while at the same time reducing manufacturing cost.

BEST MODE FOR CARRYING OUT THE INVENTION

Figure 1:
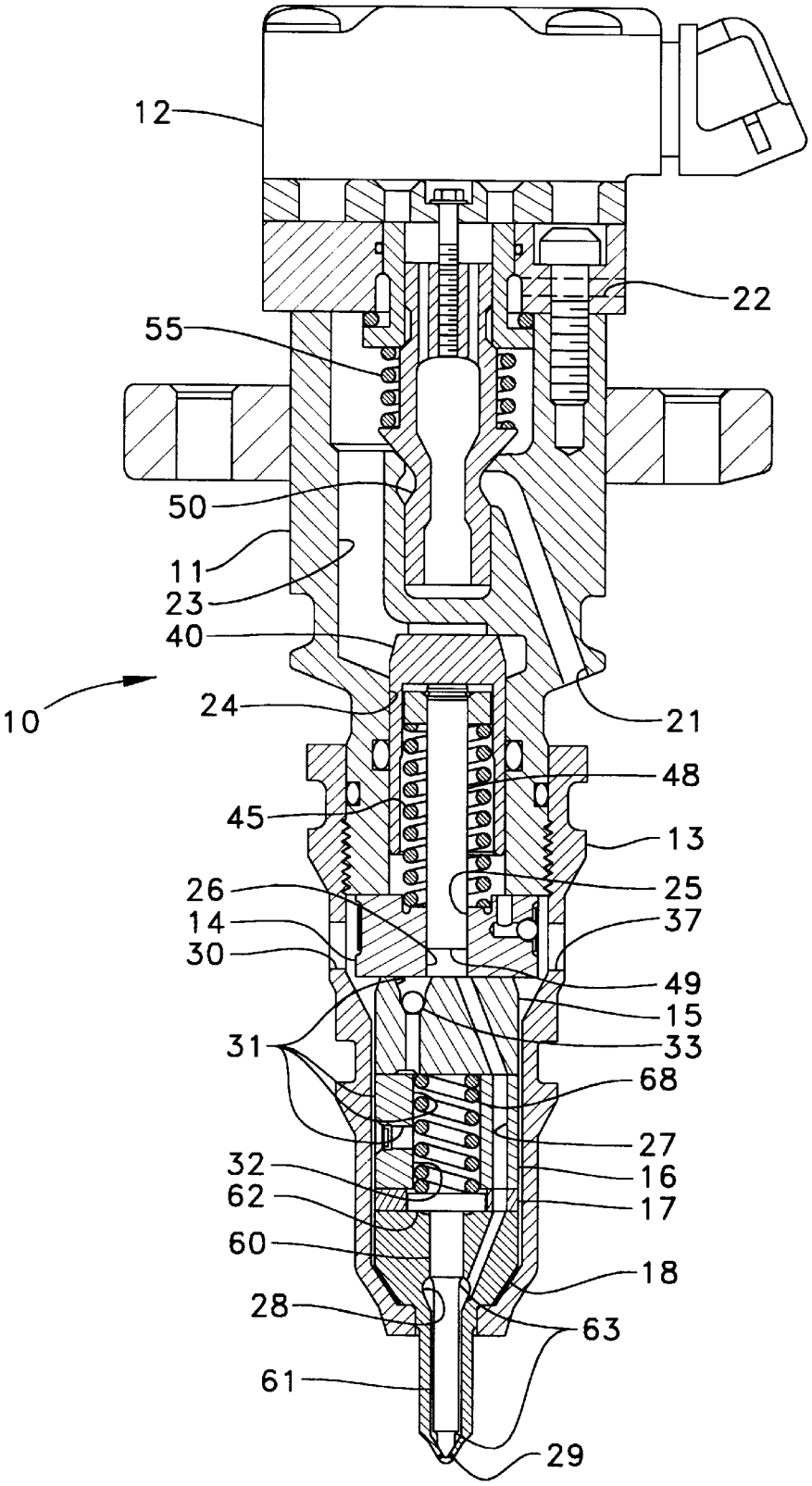
FIG. 1 is a side sectioned elevational view of a fuel injector according to one embodiment of the present invention.

Referring now to FIG. 1, the present invention will be illustrated in relation to a typical hydraulically actuated electronically controlled unit injector 10 of the type manufactured by Caterpillar, Inc. The injector body includes an upper portion 11, a solenoid housing 12 and a nozzle assembly 13. The nozzle assembly includes a cylindrical body portion with a hollow interior and a plurality of blocks 14–18 stacked on top of one another. When the nozzle assembly 13 is joined to upper body portion 11 as shown in FIG. 1, the injector body defines a fuel pressurization chamber 26 that opens to a fuel supply passage 31 and a nozzle supply passage 27. The injector body also includes a nozzle chamber 28 that opens to a nozzle outlet 29 and nozzle supply passage 27. A portion of fuel supply passage 31 is a return spring cavity 32. A check valve 33 is positioned in fuel supply passage 31 between return spring cavity 32 and fuel pressurization chamber 26. Check valve 33 is operable to prevent flow of fuel from fuel pressurization chamber 26 back into return spring cavity 32. A needle check 60 is positioned to reciprocate in the nozzle chamber 28 between a closed position that closes nozzle outlet 29 and an open position that opens nozzle outlet 29 to nozzle chamber 28. The needle check 60 in this case includes a pair of hydraulic lift surfaces 63 that are exposed to fuel pressure within nozzle chamber 28. Needle check 60 is made up of an elongated needle valve member 61 and a cylindrical spacer 62 that remain in contact with one another under the force of return spring 68.

The return spring cavity 32 is defined at least in part by one end 65 of needle check 60, an end wall 66 and a shoulder stop surface 67. A return spring 68 is compressed in return spring cavity 32 between end 65 of needle check 60 and end wall 66. Return spring 68 biases needle check 60 toward its closed position in a manner known in the art. When fuel pressure acting on hydraulic lift surfaces 63 reaches a threshold amount, needle check 60 is hydraulically pushed open against the action of return spring 68. Needle check 60 is fully open when an annular portion of end 65 comes into contact with annular shoulder stop surface 67 of return spring cavity 32. When needle check 60 is in its closed position, the annular portion of end 65 is separated from the shoulder stop surface 67 by a distance equal to the distance the needle check moves when traveling between its open position and closed position. Thus, shoulder stop surface 67 serves as the means by which the movement of needle check 60 is limited.

The upper portion 11 of the injector body includes a high pressure actuation fluid inlet 21 and a low pressure actuation fluid drain that are respectively separated from an actuation fluid cavity 23 by control valve 50. Control valve 50 is normally biased to close high pressure actuation fluid inlet 21 by return spring 55. When the solenoid (not shown) is energized, control valve 50 lifts against the action of return spring 55 and opens actuation fluid cavity 23 to high pressure actuation fluid inlet 21, while simultaneously closing low pressure actuation fluid drain 22.

The injector body also includes a piston bore 24, within which an intensifier piston 40 reciprocates between a lower position and an upper position, as shown. A plunger 48 has one end in contact with intensifier piston 40 and its other pressure face end 49 forming one wall of fuel pressurization chamber 26. Intensifier piston 40 and plunger 48 are normally biased to ward retracted positions by return spring 45. Plunger 48 reciprocates in a plunger bore 25, which is machined in a portion of upper block 14. Both a fuel supply opening 30 and a fuel return line opening 37 are in fluid contact with fuel supply passages 31.

Those skilled in the art will appreciate that each injection event of injector 10 is initiated by energizing the solenoid to open high pressure actuation fluid inlet 21. This quickly raises pressure in actuation fluid cavity 23 in order to hydraulically push intensifier piston 40 and plunger 48 downward to compress fuel contained within fuel pressurization chamber 26. Downward movement of plunger 48 compresses fuel within fuel pressurization chamber 26 until the fuel reaches a threshold pressure sufficient to overcome the action of needle check return spring 68. When this occurs, needle check 60 lifts to its open position. Fuel commences to exit nozzle outlet 29 as soon as needle check 60 begins to lift and continues until needle check 60 is closed.

In this embodiment, each injection event is ended by deactivating the solenoid to close high pressure actuation fluid inlet 21 and open actuation fluid cavity 23 to low pressure drain 22. This ceases the downward movement of piston 40 and plunger 48. Pressure within fuel pressurization chamber 26 and nozzle chamber 28 begins to drop until it eventually drops under the threshold pressure necessary to hold needle check 60 open. The injection of fuel finally ends when fuel return spring 68 pushes needle check 60 closed to close nozzle outlet 29. Between injection events, fuel refills fuel pressurization 26 by flowing along fuel supply passage 31 past check valve 33 when intensifier piston 40 and plunger 48 are retracting under the action of return spring 45.

Figure 2:
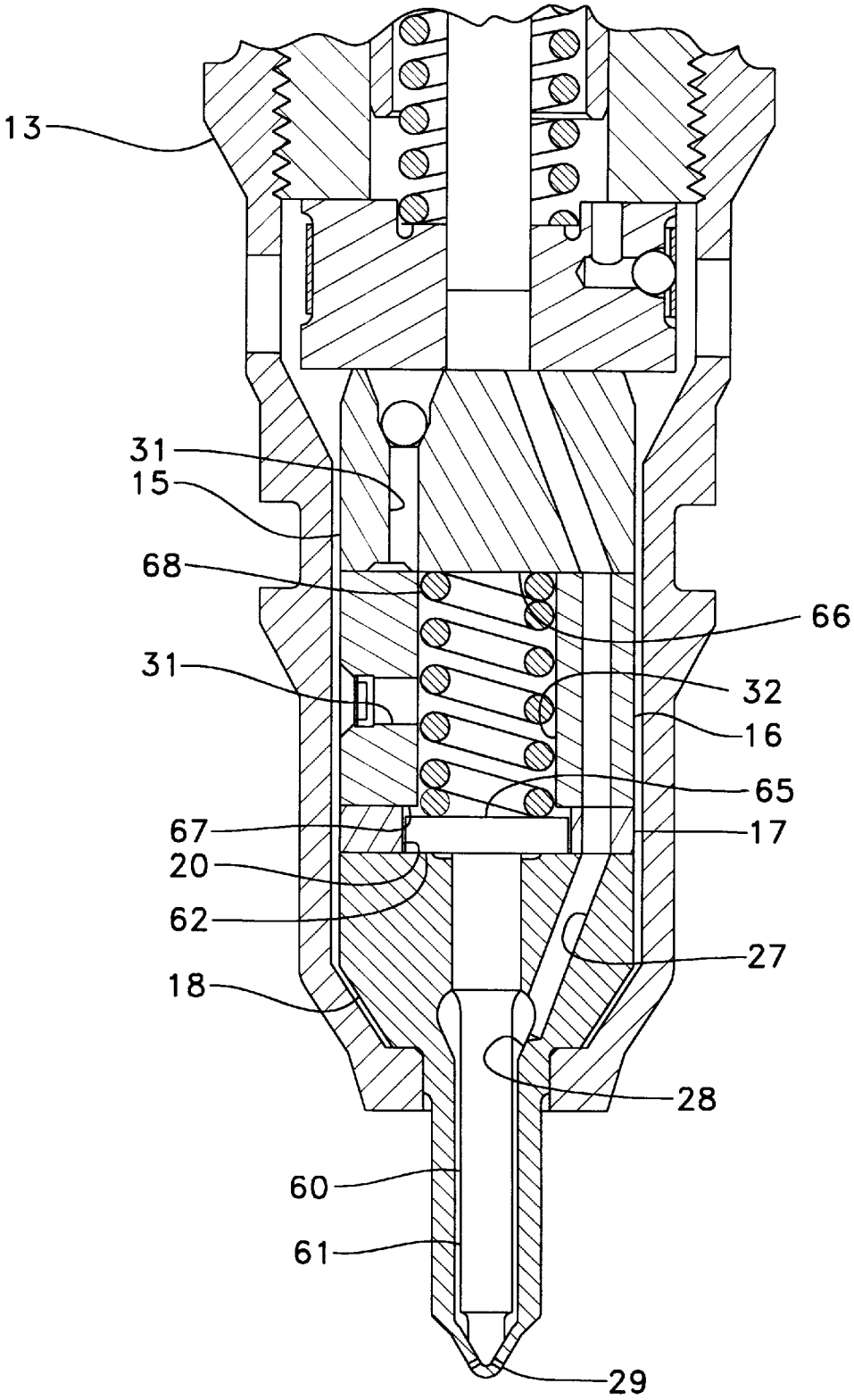
FIG. 2 is a side sectioned elevational view of a fuel injector nozzle assembly according to the prior art.
Figure 3:
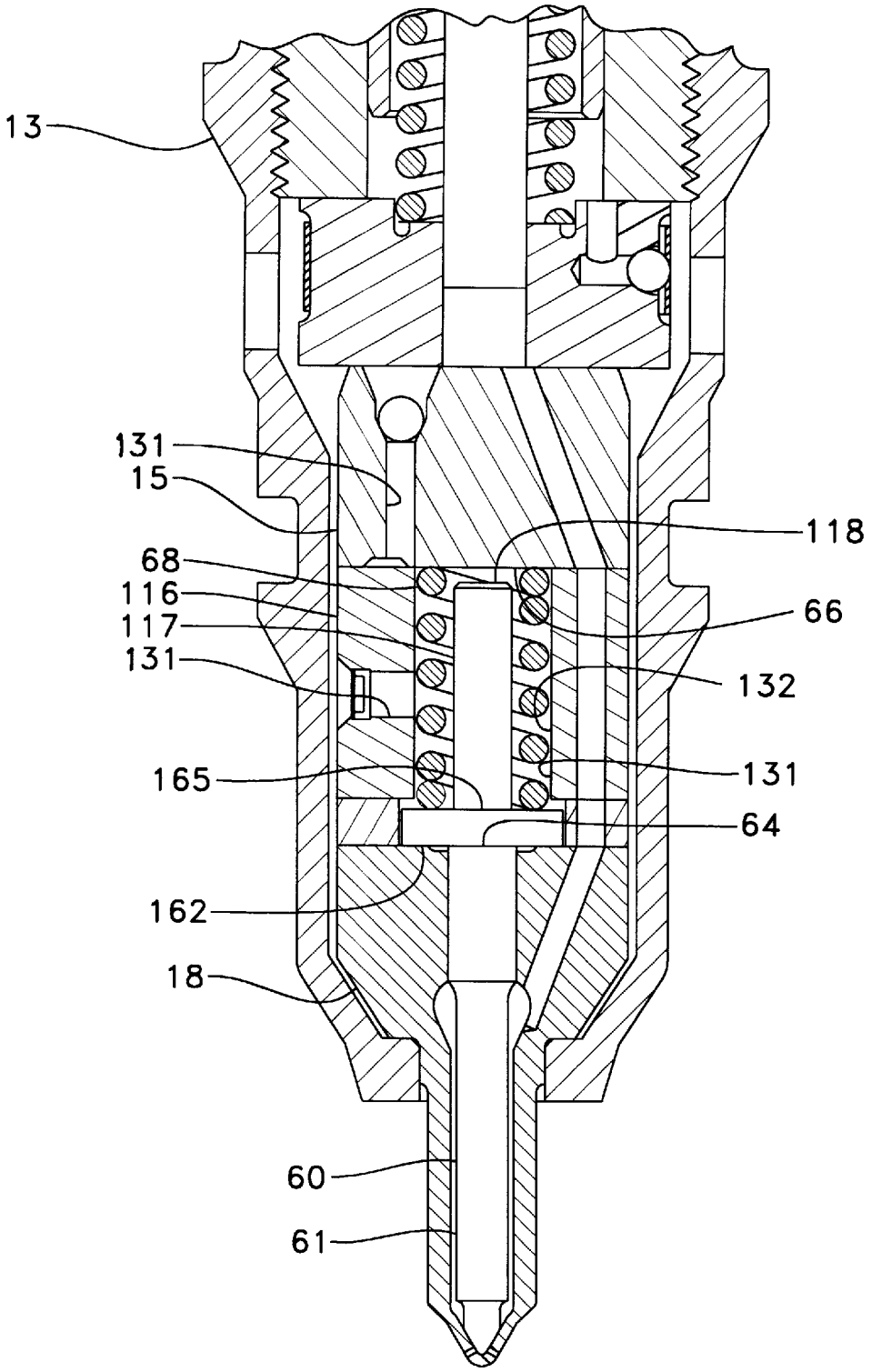
Fig-3- (PRIOR ART)
FIG. 3 is a side sectioned elevational view of a fuel injector nozzle assembly according to the present invention.

The present invention is best appreciated when compared side by side with a prior art fuel injector nozzle assembly as illustrated in FIGS. 2 and 3. Where identical numbers are used, the nozzle assembly according to the present invention is identical to that of the prior art. In other words, both assemblies include a cylindrical body 13 having a hollow interior, within which are stacked several block portions. Both spacer block 15 and nozzle block 18 of the nozzle assemblies are identical and will not be discussed further. However, in the preferred embodiment of the present invention, sleeve block 16 and 17 (FIG. 3) are utilized in place of the single sleeve block 116 of the prior art. In the prior art nozzle assembly, return spring cavity 131 is defined by a uniform cylindrically shaped bore 132 through sleeve block 116. Return spring cavity is bounded on its ends by the upper circular surface 165 of disk shaped spacer 162 and a circular end wall 66, which in this case is a portion of the underside of spacer block 15. In the prior art nozzle assembly, a stop pin 117 is positioned between end wall 66 and spacer 162. When needle check 60 is fully opened, the upper surface 118 of pin stop 117 comes into contact with end wall 66. Like the present invention, a fuel return spring 68 biases needle check 60 to its closed position.

It has been found that, although the prior art nozzle assembly generally functions quite satisfactorily, some problems can develop after the injector undergoes many injection cycles. For instance, because pin stop 117 is not attached to any other part, it is free to move around within return spring cavity 132. On most occasions, pin stop 117 can become tilted or cocked inside of return spring cavity and undermine or destroy the performance of the injector. Excessive tilted contact between return spring 68 and spacer 162 can also result in a weakening of the spring and/or an altering of the valve opening pressure for the needle check. The tilting or cocking of pin stop 117 can also cause part beat in, rotation of the pin stop and excessive wear on spacer 165 and end wall 66 of the return spring cavity. Furthermore, over time, the pin can chip after undergoing numerous cycles and release metal fragments inside the injector. Such a metal fragment could destroy the operation of the injector by for instance becoming trapped in needle check 33 (FIG. 1) and preventing the passage from closing during injection.

Because pin stop 117 takes up a significant portion of the volume of return spring cavity 132, cavitation can occur when the needle check is moving from its fully open position toward its closed position. During this time period, negative pressure is created within the return spring cavity 132 and there is insufficient fuel volume within return spring cavity to accommodate the quick drop in pressure. It has been observed that cavitation damage appears primarily at the bottom coil of return spring 68. Extensive cavitation damage can eventually result in injector failure or a significant change in the valve opening pressure of the injector. Any interference with spring 68 can also result in an alteration of the valve opening pressure for needle check 60. The pin stop is undesirable for the simple reason that it costs money to manufacture.

Another problem that has revealed itself is excessive wear on the bottom coil of return spring 68 due to tilting or cocking of spacer 162 and/or due to loss of contact between the bottom coil of the spring and spacer 162 when the check stops during opening. This phenomenon can alter valve opening pressure since only a portion of the bottom coil of the spring is in contact with the upper surface 165 of spacer 162. Eventually, excessive wear on the bottom coil of return spring 68 can result in breakage and a corresponding failure of the injector.

The present invention seeks to eliminate the pin stop and the problems associated with using the pin stop without otherwise altering the performance of a given nozzle assembly. The sleeve block 116 of the prior art nozzle assembly is replaced in the preferred embodiment of the present invention by a pair of sleeve blocks 16 and 17. Upper sleeve block 16 includes a return spring bore 32 that is about the same diameter of that of the prior art in order to hold an identical return spring 68. The lower sleeve block 17 includes a spacer bore 20 that is larger than the return spring bore 32 through upper spacer 16. Thus the transition between bore 32 and bore 20 results in the formation of an annular shoulder stop surface 67, which is actually a portion of the underside of spacer block 16. Spacer 62 of the present invention is larger in diameter than spacer 162 of the prior art by an amount about equal to the difference between spring bore 32 and spacer bore 20.

The relatively thin sleeve block 17 is thicker than spacer 62 by an amount about equal to the distance that needle check 60 moves when moving from its closed position to its open position. Thus, in the present invention the spacer 62 serves as the means by which the movement of needle check 60 is limited. In other words, an annular portion of upper surface 65 of spacer 62 comes into contact with shoulder stop surface 67 when needle check 60 is moved to its open position. This design allows the pin stop 117 to be eliminated. Otherwise, the injector performs substantially identical to that of the prior art without suffering from any of the drawbacks caused by the use of a pin stop 117 as in the prior art.

Cavitation problems are reduced or eliminated because of the increased volume available for fuel within return spring cavity 32, which like the prior art also functions as a portion of fuel supply passage 31. The present invention is also preferred because it eliminates one part interface (contact between pin stop 117 and end wall 66), and eliminates a free floating part from the injector design. The return spring also tends to maintain full face contact on the upper surface 65 of spacer 62 and maintain a reliable and steady valve opening pressure throughout its extended working life. This believed due to the enlarged diameter of spacer 62 over the prior art and the peripheral contact between upper surface 65 and shoulder stop surface 67.

Industrial Applicability

Although the present invention has been illustrated in relation to a hydraulically actuated electronically controlled fuel injector of the type manufactured by Caterpillar, Inc., the present invention finds potential application in any fuel injector nozzle assembly that utilizes the check return spring cavity as a portion of the fuel supply passage to the fuel pressurization chamber of the injector. Nozzle assemblies according to the present invention could also be utilized in cam driven fuel injectors in which a cam driven tappet is utilized to raise fuel pressure to initiate an injection event. Those skilled in the art will appreciate that the present invention can be incorporated into numerous fuel injector designs without altering the performance of the injector.

For instance, in the case of the illustrated embodiment, the only difference between the prior art nozzle assembly and the nozzle assembly of the present invention was the change from a single sleeve block 116 to a pair of sleeve blocks 16 and 17, the elimination of pin stop 117 and the enlarged diameter of the spacer 62. This change prolongs the life of the injector without otherwise altering its performance.

In another embodiment of the present invention, sleeve block 16 and 17 could be machined from a single block such that spacer bore 20 would actually be a larger diameter counter bore. However the dual block 16–17 version illustrated is preferred because of the ease with which a perpendicular shoulder stop surface 67 can be created by using-two blocks rather than attempting to machine such a shoulder in a single block.

Although the present invention has been illustrated in relation to a certain fuel injector nozzle assembly, the same is not intended to limit the scope of the present invention in any way. Those skilled in the art will appreciate that the concepts taught herein can be applied to solve problems in numerous different fuel injectors without departing from the intended scope of the invention, which is defined solely in terms of the claims set forth below.

What is claimed is:

1. A fuel injector comprising:

an injector body having a fuel pressurization chamber that opens to a fuel supply passage and a nozzle supply passage, and having a nozzle chamber that opens to a nozzle outlet and said nozzle supply passage;

a portion of said fuel supply passage being a return spring cavity;

a check valve positioned in said fuel supply passage between said return spring cavity and said fuel pressurization chamber and being operable to prevent flow of fuel from said fuel pressurization chamber back into said return spring cavity;

a needle check positioned to reciprocate in said nozzle chamber between a closed position that closes said nozzle outlet and an open position that opens said nozzle outlet, said needle check including at least one hydraulic lift surface exposed to said nozzle chamber;

said return spring cavity being defined at least in part by one end of said needle check, an end wall and a shoulder stop surface;

a return sprint compressed in said return spring cavity between said one end of said needle check and said end wall;

said one end of said needle check being in contact with said shoulder stop surface of said return spring cavity when said needle check is in said open position but being separated from said shoulder stop surface when said needle check is in said closed position;

said needle check including an elongated needle valve member and a cylindrical spacer in contact with one end of said needle valve member;

said one end of said needle check being one side of said spacer; and said injector body includes a relatively thin block defining a bore therethrough sized to receive said spacer.

2. The fuel injector of claim 1 wherein said thin block is an amount thicker than said spacer; and said amount is about equal to a distance said needle check moves when traveling between said open position and said closed position.

3. The fuel injector of claim 2 wherein said injector body includes a second block that defines a portion of said return spring cavity stacked on top of said thin block; and said shoulder stop surface is a portion of said second block.

4. A nozzle assembly for a fuel injector comprising:

a cylindrical body portion defining a hollow interior;

a plurality of blocks positioned in said hollow interior and stacked on top of one another;

said cylindrical body and said plurality of blocks defining a fuel supply passage, a nozzle supply passage and a nozzle outlet, and further defining a nozzle chamber that opens to a nozzle outlet and said nozzle supply passage;

a portion of said fuel supply passage being a return spring cavity;

a needle check positioned to reciprocate in said nozzle chamber between a closed position that closes said nozzle outlet and an open position that opens said nozzle outlet, said needle check including at least one hydraulic lift surface exposed to said nozzle chamber;

said return spring cavity being defined at least in part by one end of said needle check, an end wall and a shoulder stop surface;

a return spring compressed in said return spring cavity between said one end of said needle check and said end wall;

said one end of said needle check being in contact with said shoulder stop surface of said return spring cavity when said needle check is in said open position but being separated from said shoulder stop surface when said needle check is in said closed position;

said needle check including an elongated needle valve member and a cylindrical spacer in contact with one end of said needle valve member;

said one end of said needle check being one side of said spacer; and said cylindrical body portion includes a relatively thin block defining a bore therethrough sized to receive said spacer.

5. The nozzle assembly of claim 4 wherein said thin block is an amount thicker than said space and said amount is about equal to a distance said needle check moves when traveling between said open position and said closed position.

6. The nozzle assembly of claim 5 wherein said cylindrical body portion includes a second block that defines a portion of said return spring cavity stacked an top of said thin block; and said shoulder stop surface is a portion of said second block.

7. A fuel injector comprising:

an injector body defining a nozzle outlet and including a first block defining a bore, and a second block stacked on, and fixed in position relative to, said first block;

a needle check positioned in said injector body and being movable between a closed position that closes said nozzle outlet, and an open position that opens said nozzle outlet, and said needle check including a cylindrical spacer received in said bore and an elongated needle valve member in a fixed position relative to said cylindrical spacer;

a spring compressed between said injector body and said needle check;

said spacer being in contact with said second block when said needle check is in said open position, but being out of contact with said second block when said needle check is in said closed position.

8. The fuel injector of claim 7 wherein said first block is thicker than said spacer by an amount; and said amount is equal to a distance said needle check moves when traveling between said open position and said closed position.

9. The fuel injector of claim 8 wherein said spacer is larger in diameter than said spring.

* * * * *